US008876144B1

(12) United States Patent
Darnell

(10) Patent No.: US 8,876,144 B1
(45) Date of Patent: Nov. 4, 2014

(54) SNOW MOBILITY DEVICE

(71) Applicant: Eric Darnell, South Strafford, VT (US)

(72) Inventor: Eric Darnell, South Strafford, VT (US)

( * ) Notice: Subject to any disclaimer, the term of this patent is extended or adjusted under 35 U.S.C. 154(b) by 0 days.

(21) Appl. No.: 13/970,859

(22) Filed: Aug. 20, 2013

(51) Int. Cl.
*A63C 9/00* (2012.01)
*A63C 5/06* (2006.01)
*A63C 5/044* (2006.01)

(52) U.S. Cl.
CPC .. *A63C 5/06* (2013.01); *A63C 5/044* (2013.01)
USPC ..... 280/611

(58) Field of Classification Search
USPC ..... 280/604–609, 14.2, 87.042, 28.16, 15, 280/18, 28.11, 23.14
See application file for complete search history.

(56) References Cited

U.S. PATENT DOCUMENTS 3,927,896 A * 12/1975 Detoia ..... 280/604
6,189,912 B1 * 2/2001 Ritzinger ..... 280/609

* cited by examiner

*Primary Examiner* — John Walters
*Assistant Examiner* — James Triggs
(74) *Attorney, Agent, or Firm* — Brian M. Dingman; Dingman, McInnes & McLane, LLP

(57) ABSTRACT

A snow mobility device that defines a longitudinal axis, the snow mobility device having a generally planar deck with a top surface and a bottom surface, the deck defining a front portion, a rear portion, a middle portion, and outer edges. The middle portion is generally flat and the front and rear portions are each curved upwardly. The edges are rounded. There are at least two rails extending outwardly from the bottom surface along all of the middle portion and at least some of each of the front and rear portions of the deck, the rails spaced from one another and essentially parallel to the longitudinal axis of the snow mobility device.

14 Claims, 31 Drawing Sheets

SNOW MOBILITY DEVICE

FIELD

This disclosure relates to a device that is worn by a person to assist with mobility on snow and ice.

BACKGROUND

Snowshoes cannot be used to glide while perambulating, and cannot be used to slide downhill. Skis allow sliding motions but are not practical for use traversing distances over flat or gently-sloped terrain. Skis are also difficult to carry.

SUMMARY

Featured in this disclosure is a snow mobility device that defines a longitudinal axis, the snow mobility device comprising a generally planar deck with a top surface and a bottom surface, the deck defining a front portion, a rear portion, and a middle portion, and outer edges, wherein the middle portion is generally flat and the front and rear portions are each curved upwardly. At least some of the front portion may be constructed such that its bottom surface is concave. The edges are rounded. There are at least two rails extending outwardly from the bottom surface along all of the middle portion of the deck and at least some of each of the front and rear portions, the rails spaced from one another and essentially parallel to the longitudinal axis of the snow mobility device.

The rails may be generally triangular shaped in cross section, with the base on the bottom of the deck and the vertex located farthest from the bottom. There may be two rails, with the rails essentially equally spaced from the longitudinal edges of the deck. The rails may be generally parallel along their lengths except for along the front portion where they diverge outwardly from each other, to define a funnel that guides snow into the space between the rails. The rails may extend to or very close to the edges of the front portion.

The snow mobility device may further comprise one or more retractable cleats coupled to the deck. The cleats may be generally "V"-shaped. Each cleat may be part of a cleat assembly that comprises a lever that couples with the cleat, and a housing that holds the lever such that it can be operated by a user to extend and retract the cleat relative to the deck. Each cleat assembly may comprise a cleat, a lever, a housing base and a housing cover, wherein the base is attached to the deck and the lever comprises a structure located inside of the cover and that fits into an opening in the cleat. The levers may be operable together, for example using a pivot mechanism. The pivot mechanism may be mounted forward of the two cleat assemblies and act to tie them together so that the two cleats can be extended and retracted together, in unison. There may be a wire that is held in the pivot mechanism and in both cleat assemblies, to tie all three together.

BRIEF DESCRIPTION OF THE DRAWINGS

Embodiments are shown in the drawings, in which:

FIGS. 1H-1L show a different example (and the currently-preferred embodiment) in which the cleat assembly mounting holes are outside of the rails, and there is a central raised platform that is part of the deck.

DETAILED DESCRIPTION

The disclosure is a snow mobility device that is constructed and arranged to accept a back-country type binding. The snow mobility devices are worn on each foot, almost like snowshoes. They can be used to walk on snow and are also adapted to glide during a step and also downhill, and so can be used almost like skis.

Figure 1A:
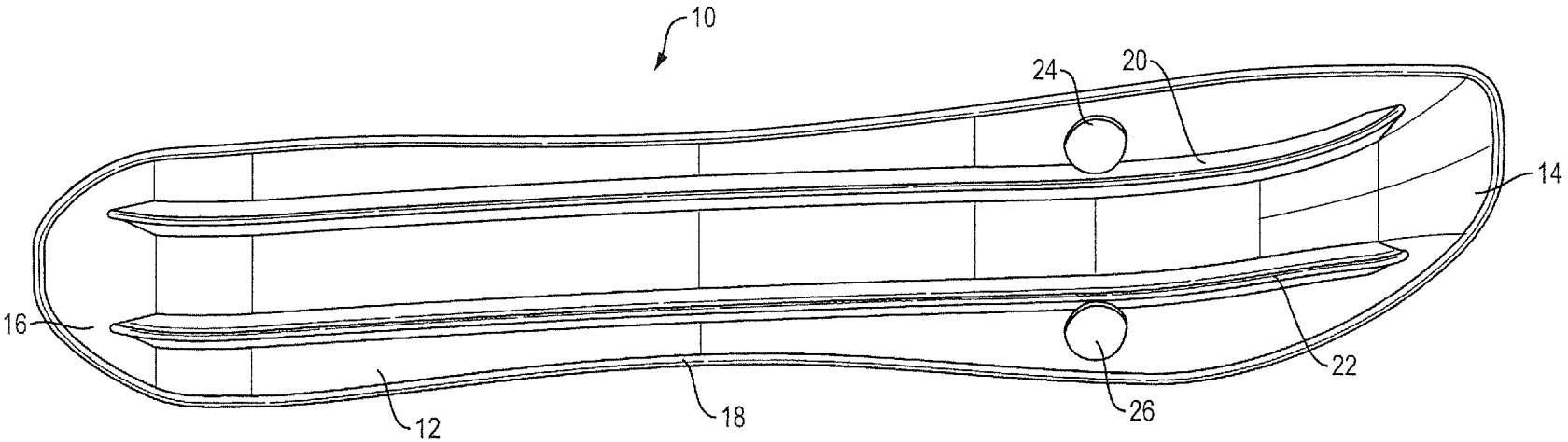
FIG. 1A is a top perspective view of snow mobility device deck.
Figure 1B:
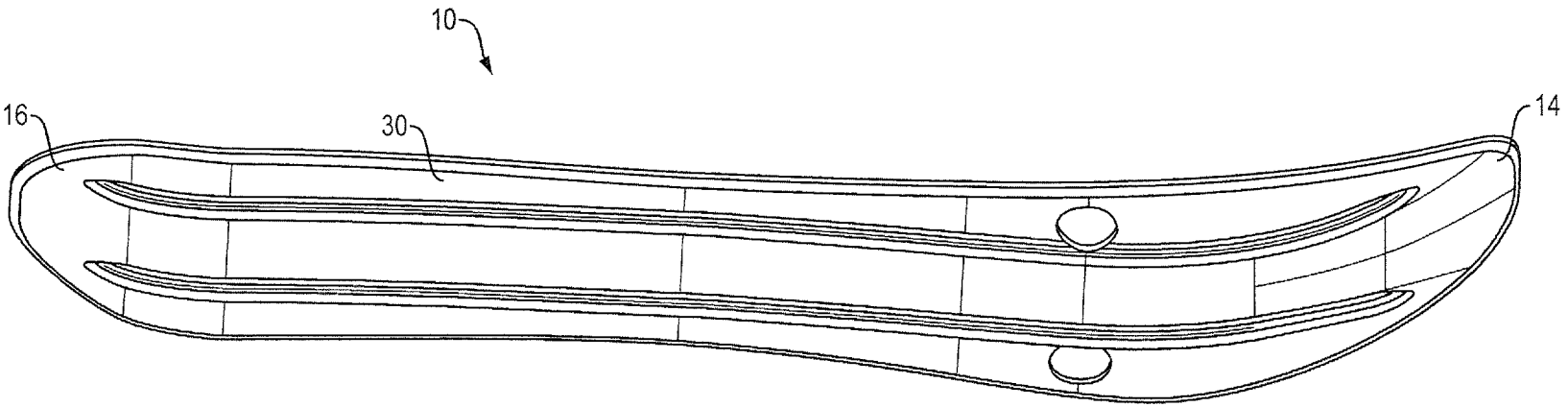
FIG. 1B is a bottom perspective view of the snow mobility device deck.
Figure 1C:
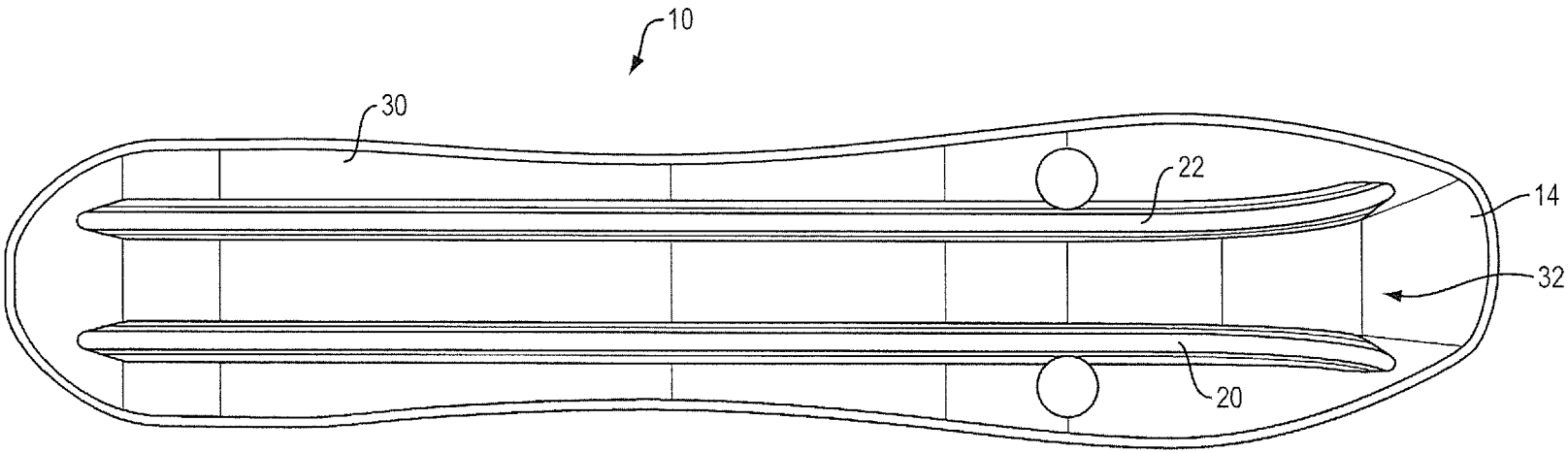
FIG. 1C is a bottom view of the deck.
Figure 1D:
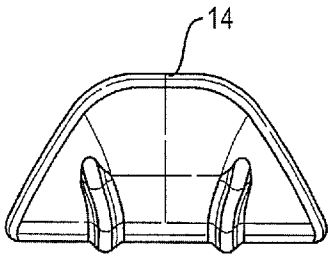
FIG. 1D is a front view of the deck.
Figure 1E:
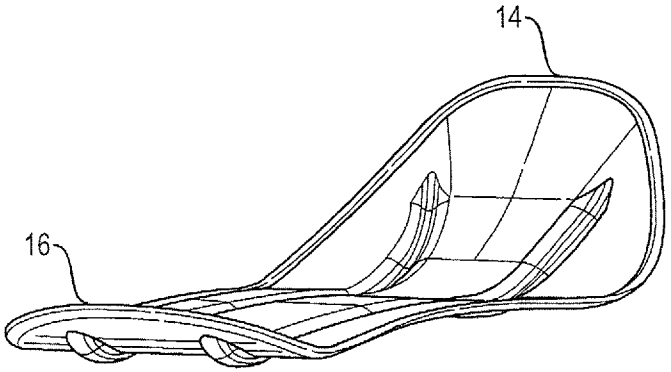
FIG. 1E is a top perspective view of the deck.
Figure 1F:
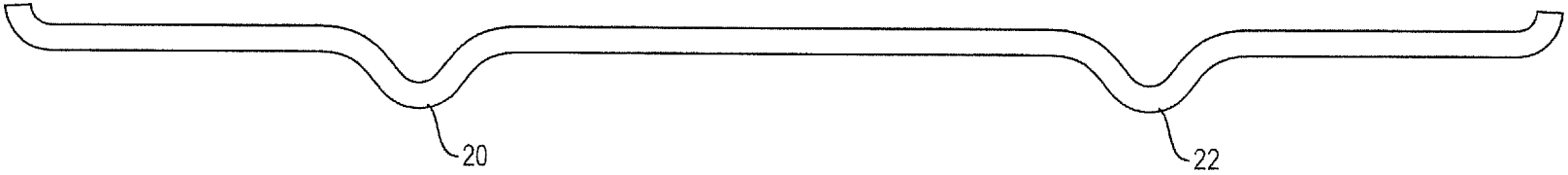
FIG. 1F is a cross-sectional view through the front portion of the deck.
Figure 1G:
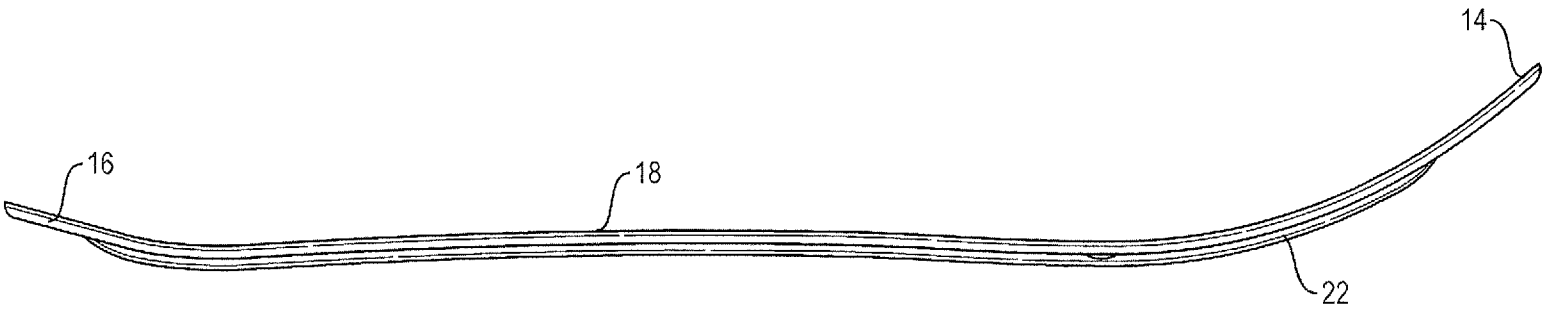
FIG. 1G is a side view of the deck.
Figure 1H:
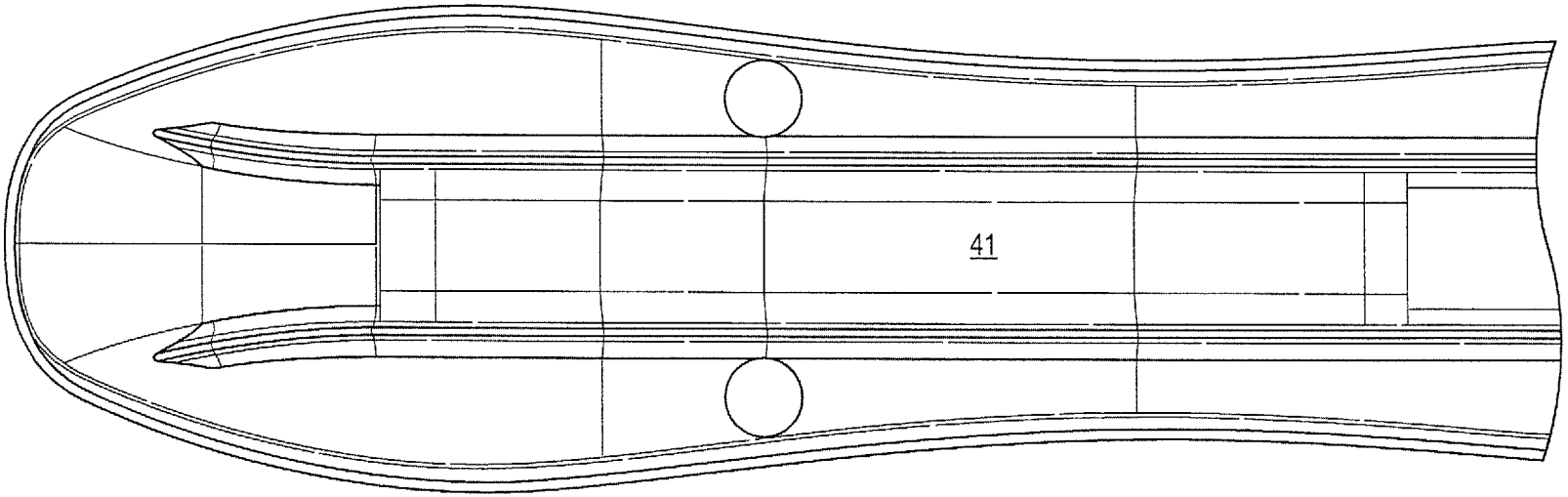
Figure 11:
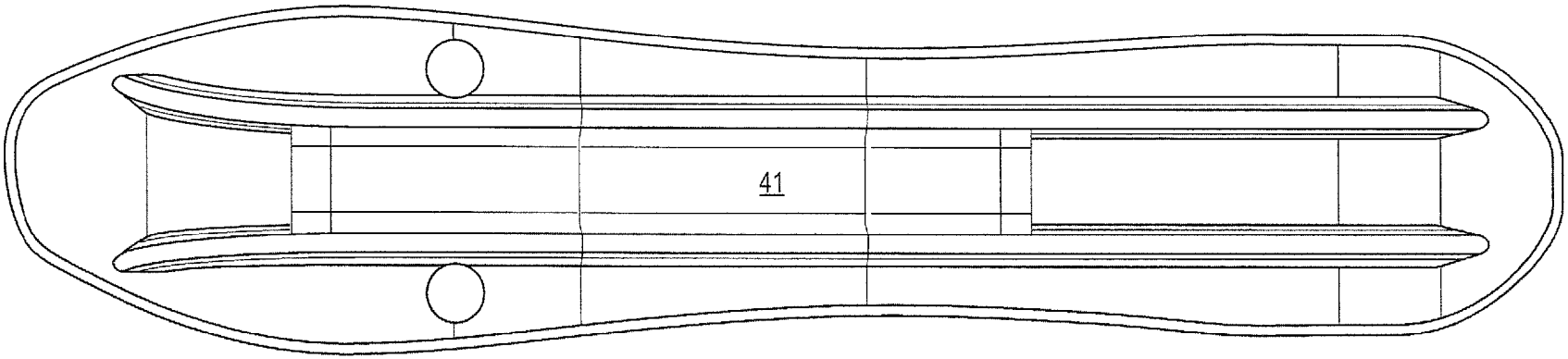
Figure 1J:
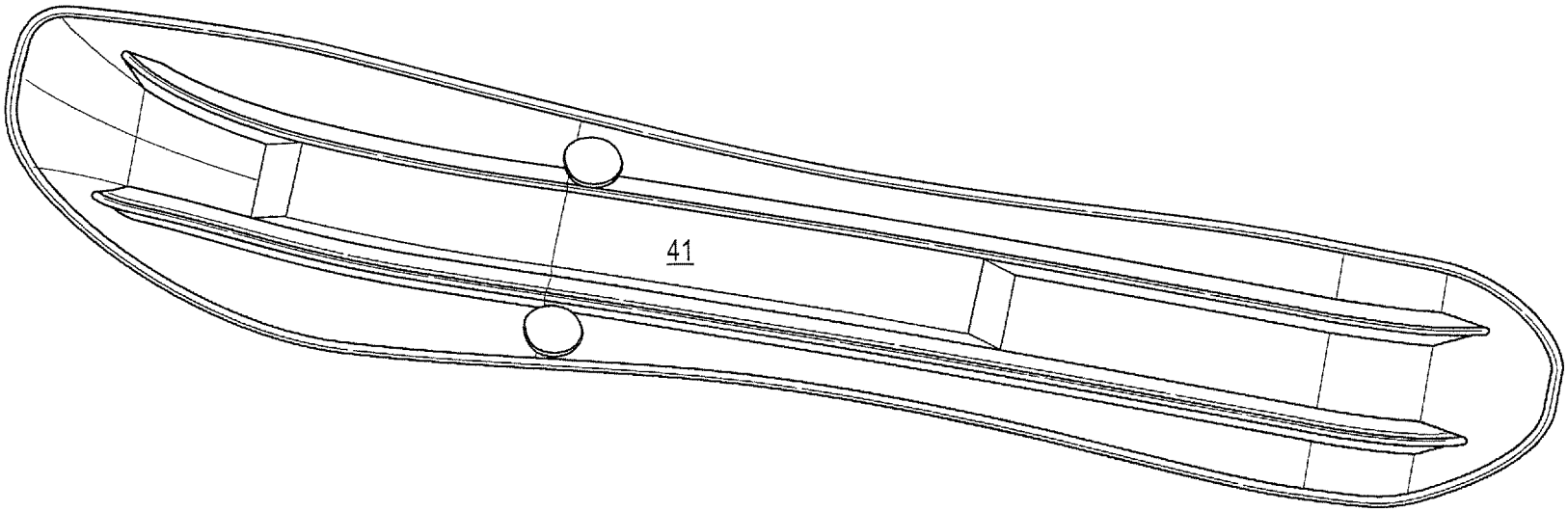
Figure 1K:
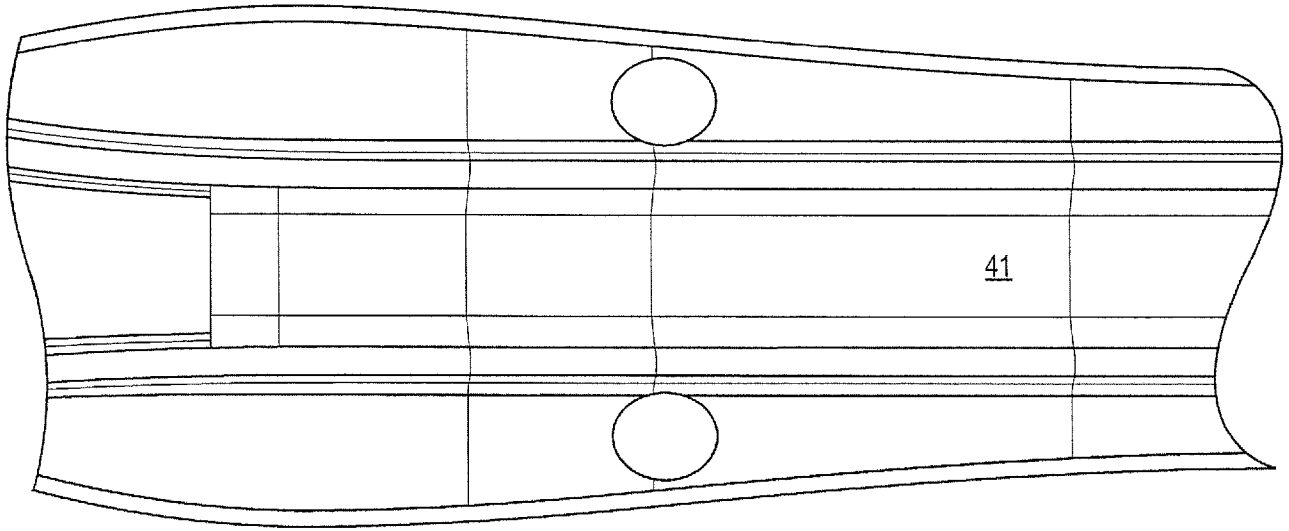
Figure 1L:
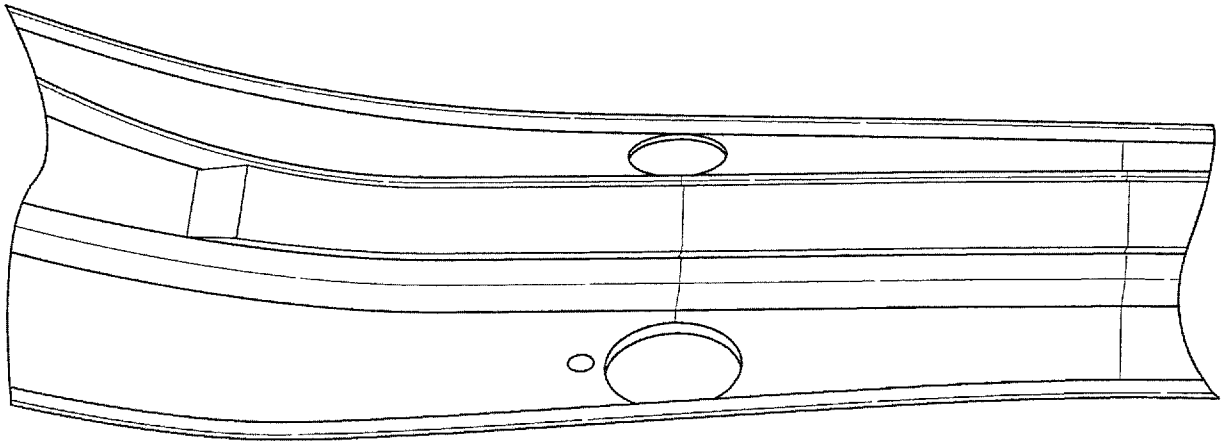

Embodiments are shown in the drawings, in which FIG. 1A is a top perspective view of snow mobility device deck 10; FIG. 1B is a bottom perspective view of snow mobility device deck 10; FIG. 1C is a bottom view of deck 10; FIG. 1D is a front view of deck 10; FIG. 1E is a top perspective view of deck 10; FIG. 1F is a cross-sectional view through the front portion of deck 10; and FIG. 1G is a side view of deck 10. FIGS. 1H-1L show a different example (and the currently-preferred embodiment) in which the cleat assembly mounting holes are outside of the rails, and there is a central raised platform 41 that is part of the deck, which is further described below.

Figure 2A:
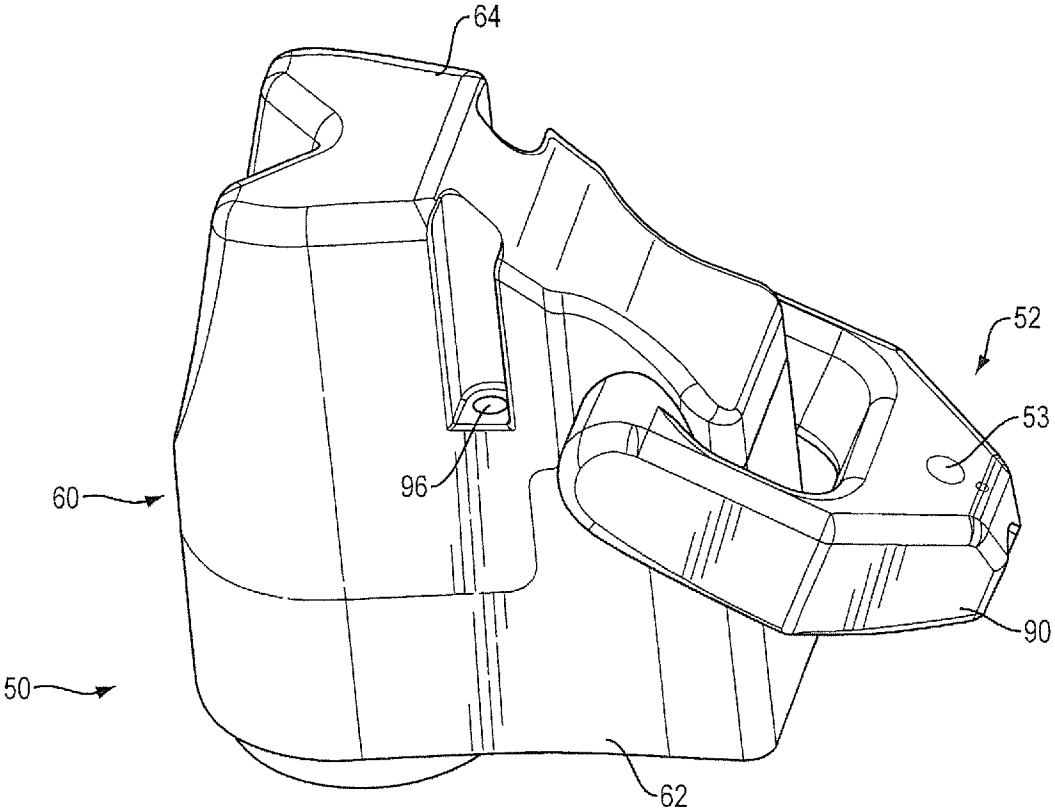
FIG. 2A is a top perspective view of a cleat assembly, with the cover portion of the assembly shown in transparent mode.
Figure 2B:
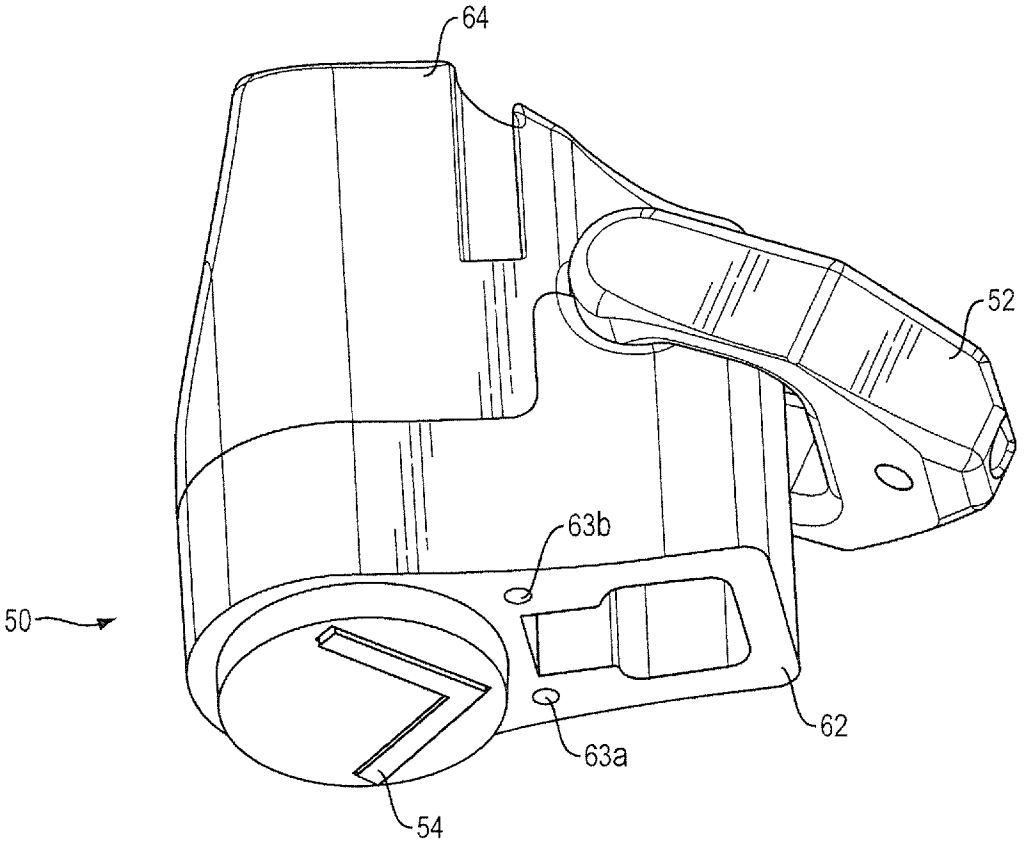
FIG. 2B is a bottom perspective view thereof.
Figure 2C:
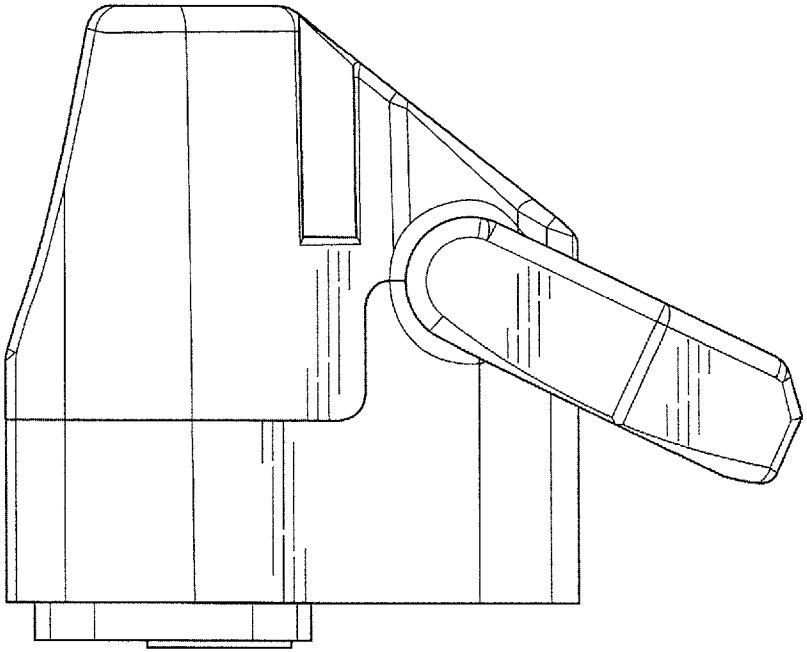
FIG. 2C is a side view thereof and FIG. 2D is a top view, shaded.
Figure 2D:
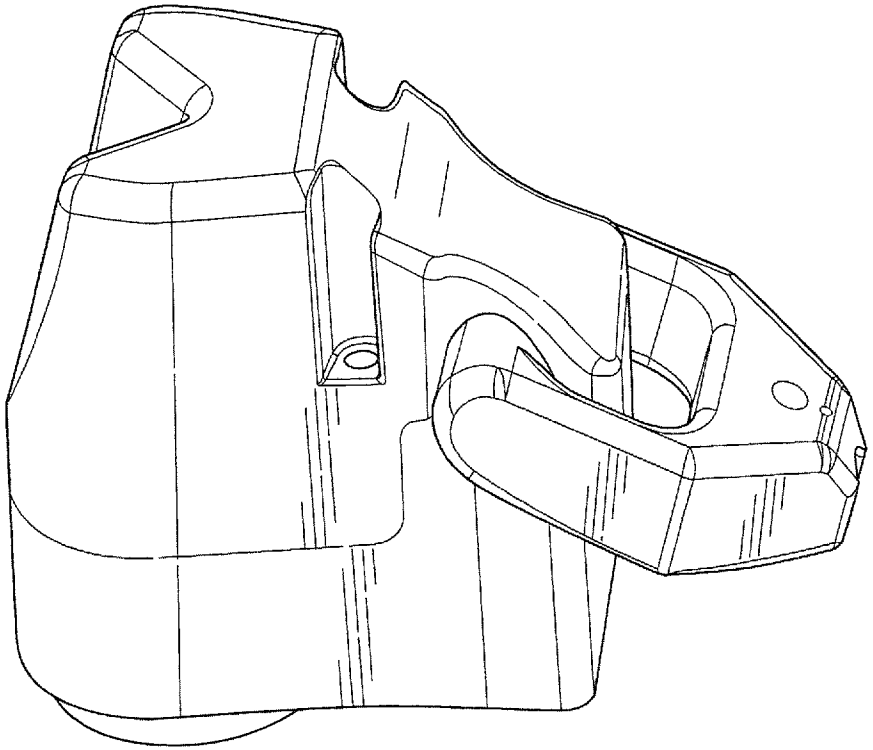
Figure 3:
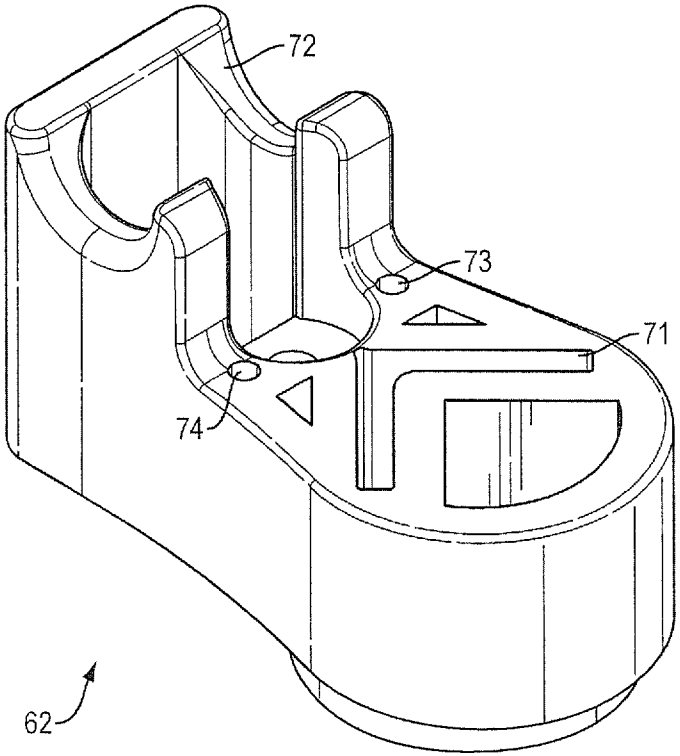
FIG. 3 is a top perspective view of the base of the cleat assembly.
Figure 4:
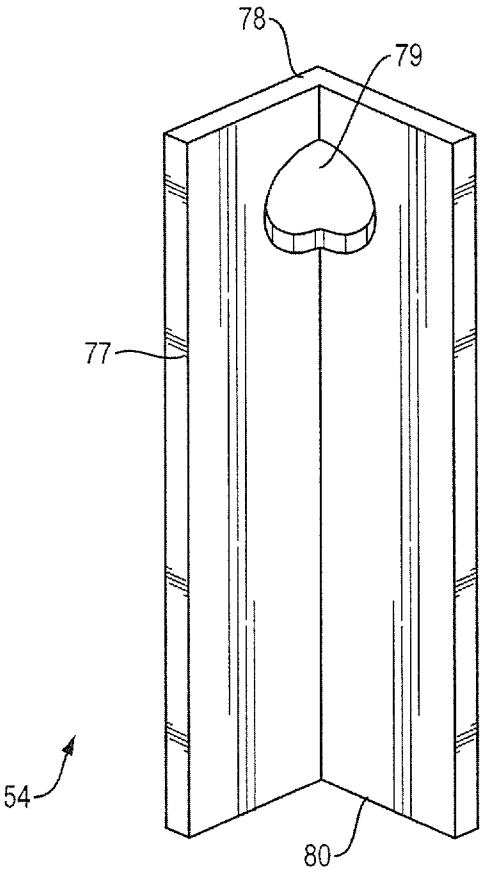
FIG. 4 is a perspective view of a cleat of the cleat assembly.
Figure 5:
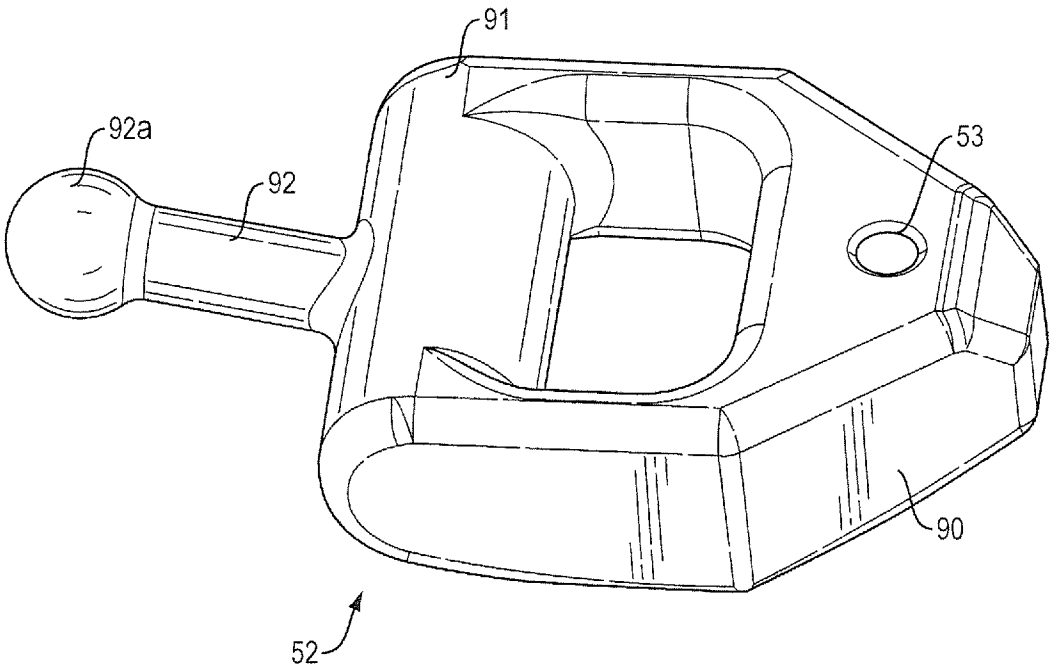
FIG. 5 is a top perspective view of the axle or lever of a cleat assembly.
Figure 6A:
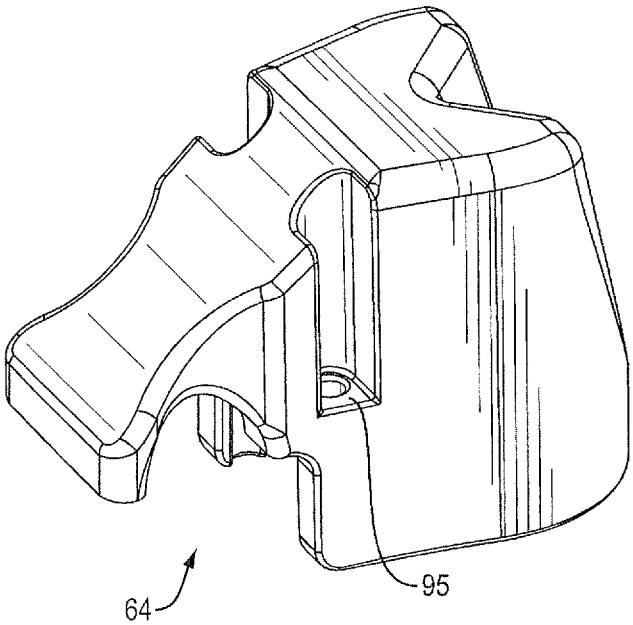
FIGS. 6A and 6B are top and bottom perspective views of a housing cover of the cleat assembly.
Figure 6B:
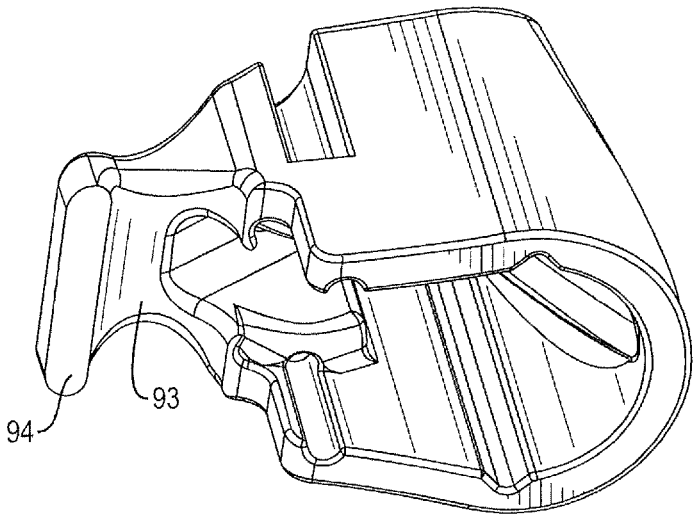

FIG. 2A is a top perspective view of a cleat assembly 50 that is attached to deck 10 (with the cover portion of the assembly shown in transparent mode); FIG. 2B is a bottom perspective view thereof; FIG. 2C is a side view thereof and FIG. 2D is a top view, shaded. FIG. 3 is a top perspective view of base 62 of cleat assembly 50. FIG. 4 is a perspective view of cleat 54 of cleat assembly 50. FIG. 5 is a top perspective view of axle or lever 52 of cleat assembly 50. FIGS. 6A and 6B are top and bottom perspective views of housing cover 64 of cleat assembly 50.

Figure 7A:
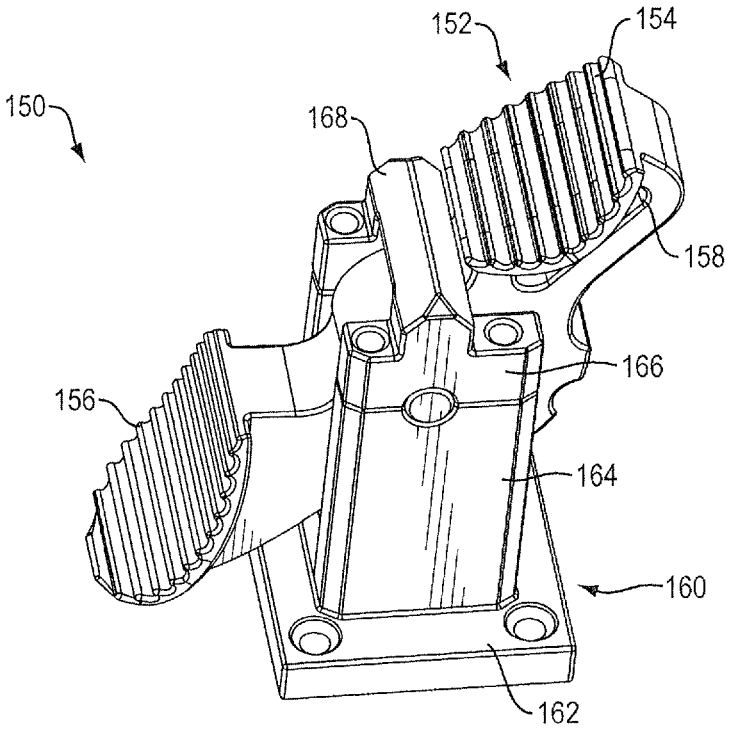
FIG. 7A is a perspective view of a pivoting cleat operator.
Figure 7B:
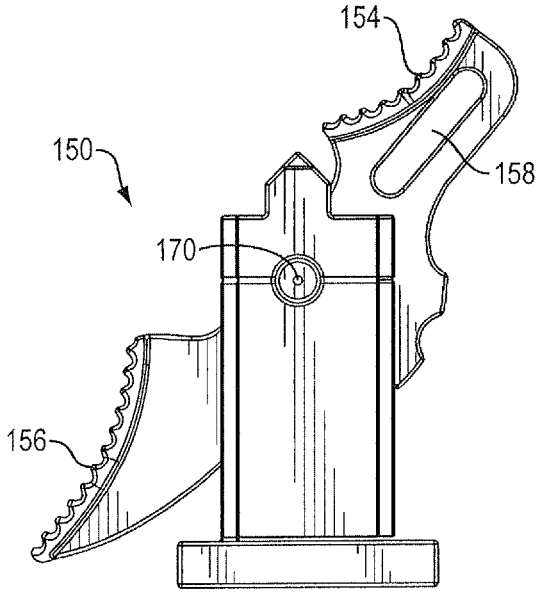
FIG. 7B is a side view thereof.
Figure 7C:
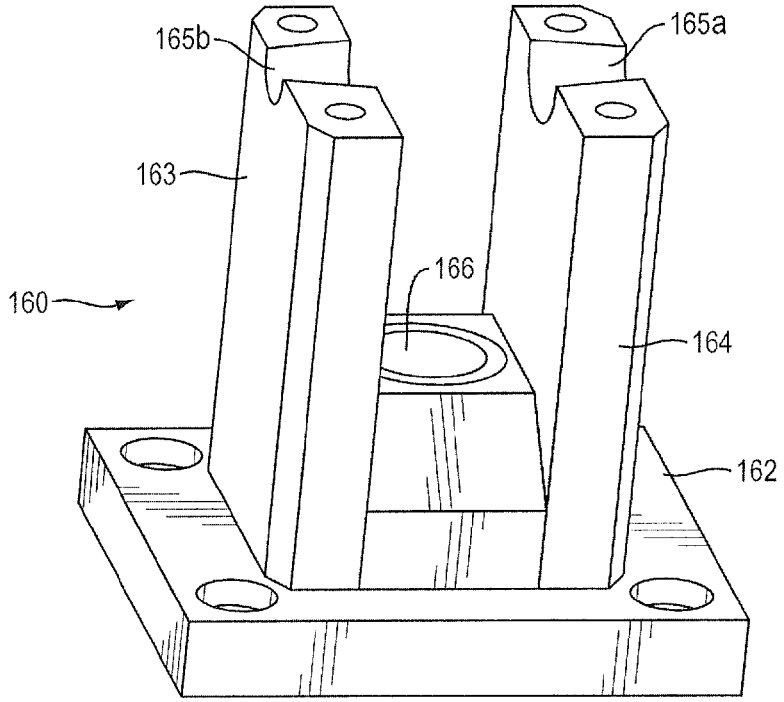
FIG. 7C shows the pivot hinge block of the pivoting cleat operator.
Figure 7D:
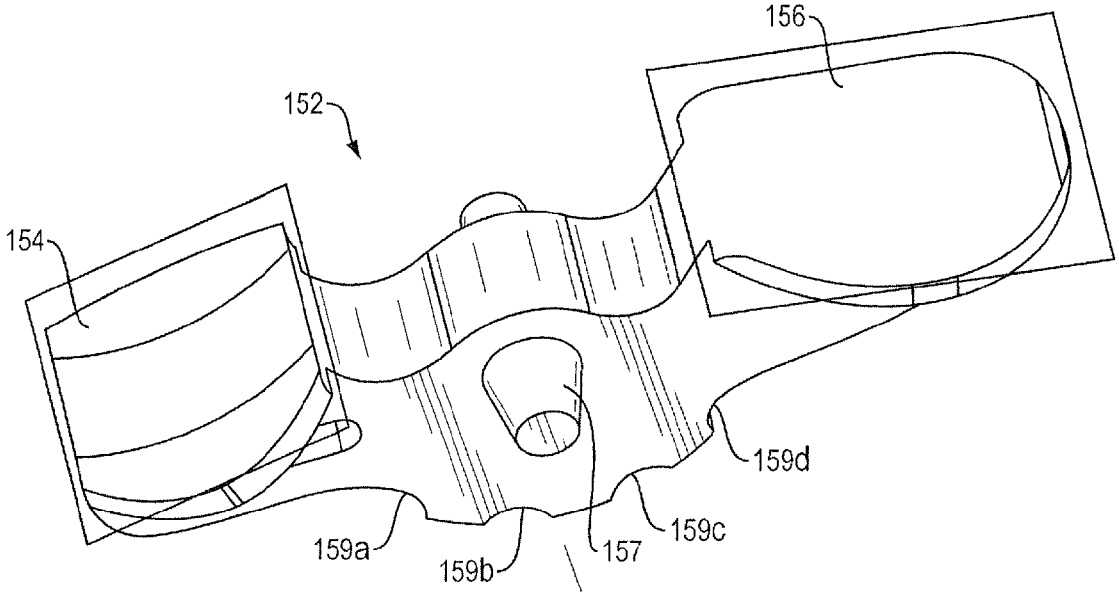
FIG. 7D is a top perspective view of the toggle lever of the pivoting cleat operator.
Figure 7E:
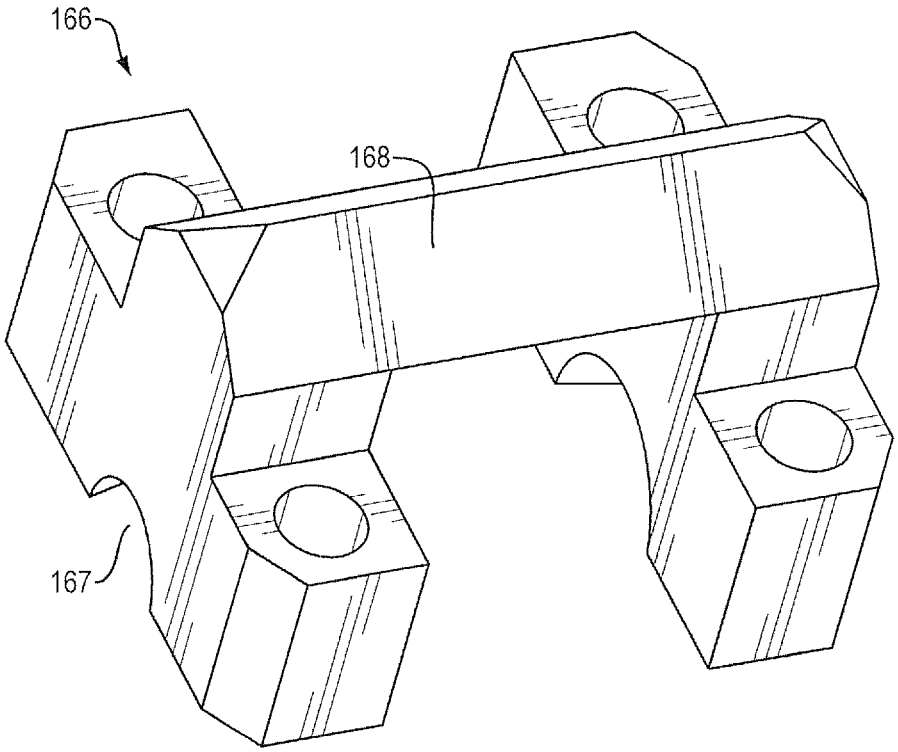
FIG. 7E is a top perspective view of the pivot hinge cap of the pivoting cleat operator.
Figure 8:
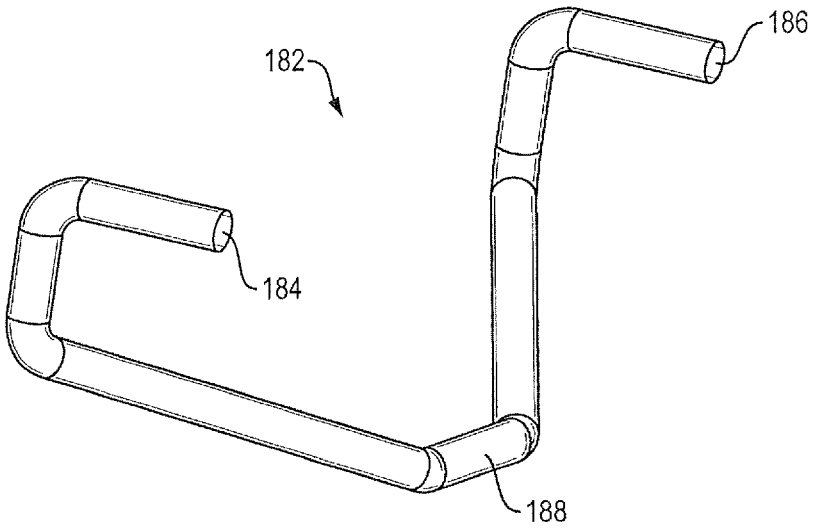
FIG. 8 shows a wire that connects the pivoting cleat operator to the two cleat assemblies.

FIG. 7A is a perspective view of a pivoting cleat operator; FIG. 7B is a side view thereof; FIG. 7C shows the pivot hinge block of the pivoting cleat operator; FIG. 7D is a top perspective view of the toggle lever of the pivoting cleat operator; FIG. 7E is a top perspective view of the pivot hinge cap of the pivoting cleat operator; FIG. 8 shows the wire that connects the pivoting cleat operator to the two cleat assemblies.

Figure 9A:
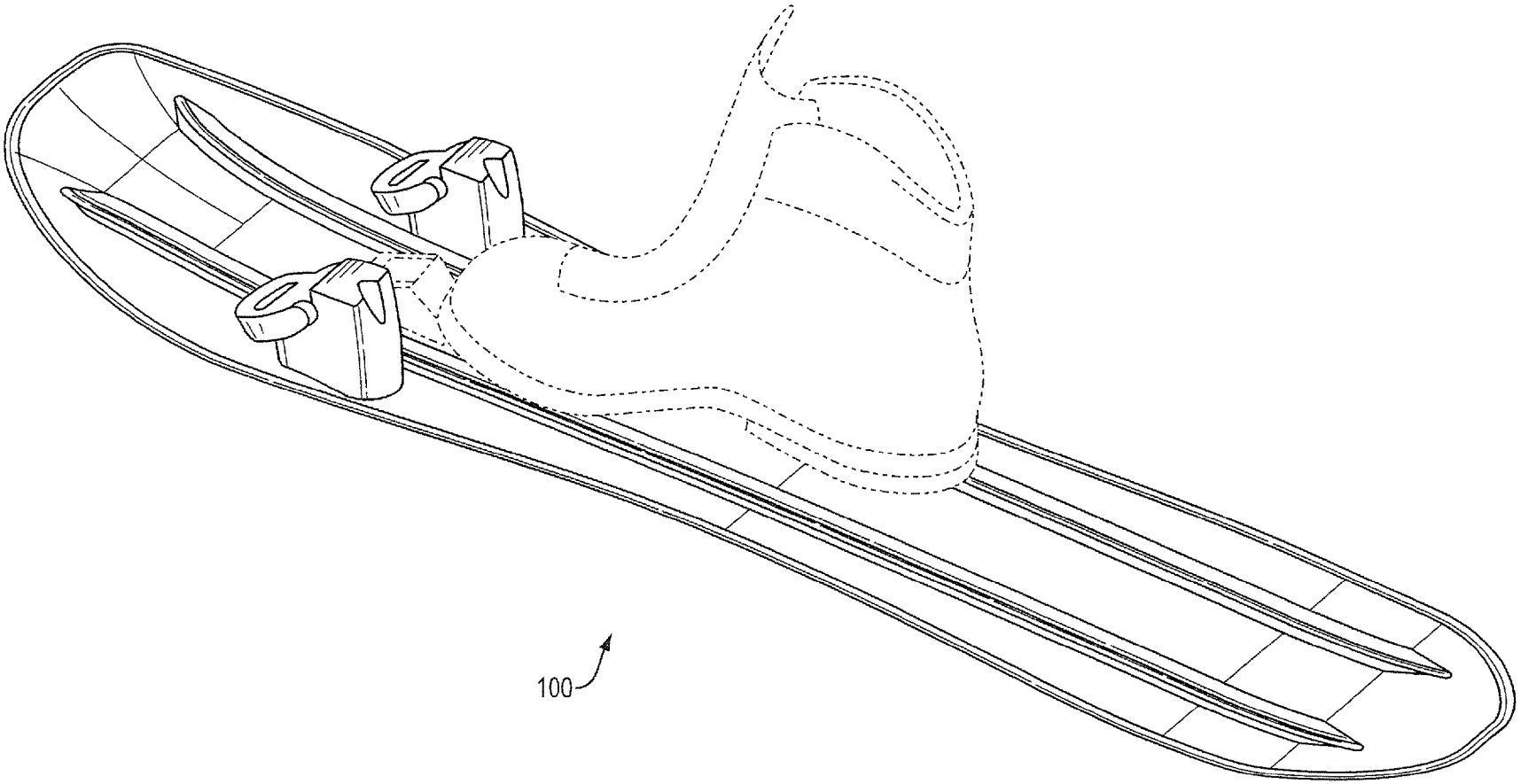
FIG. 9A is a top perspective view of the snow mobility device with a boot mounted thereon.
Figure 9B:
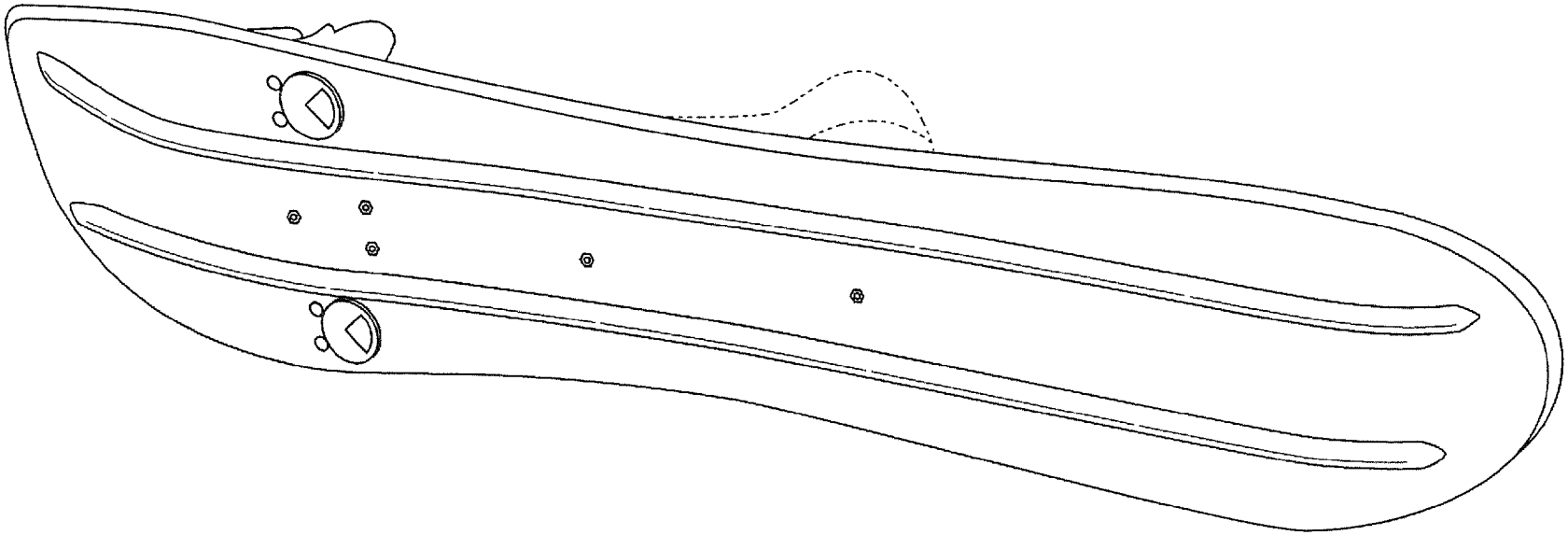
FIG. 9B is a bottom perspective view of the snow mobility device with the two cleats retracted.
Figure 9C:
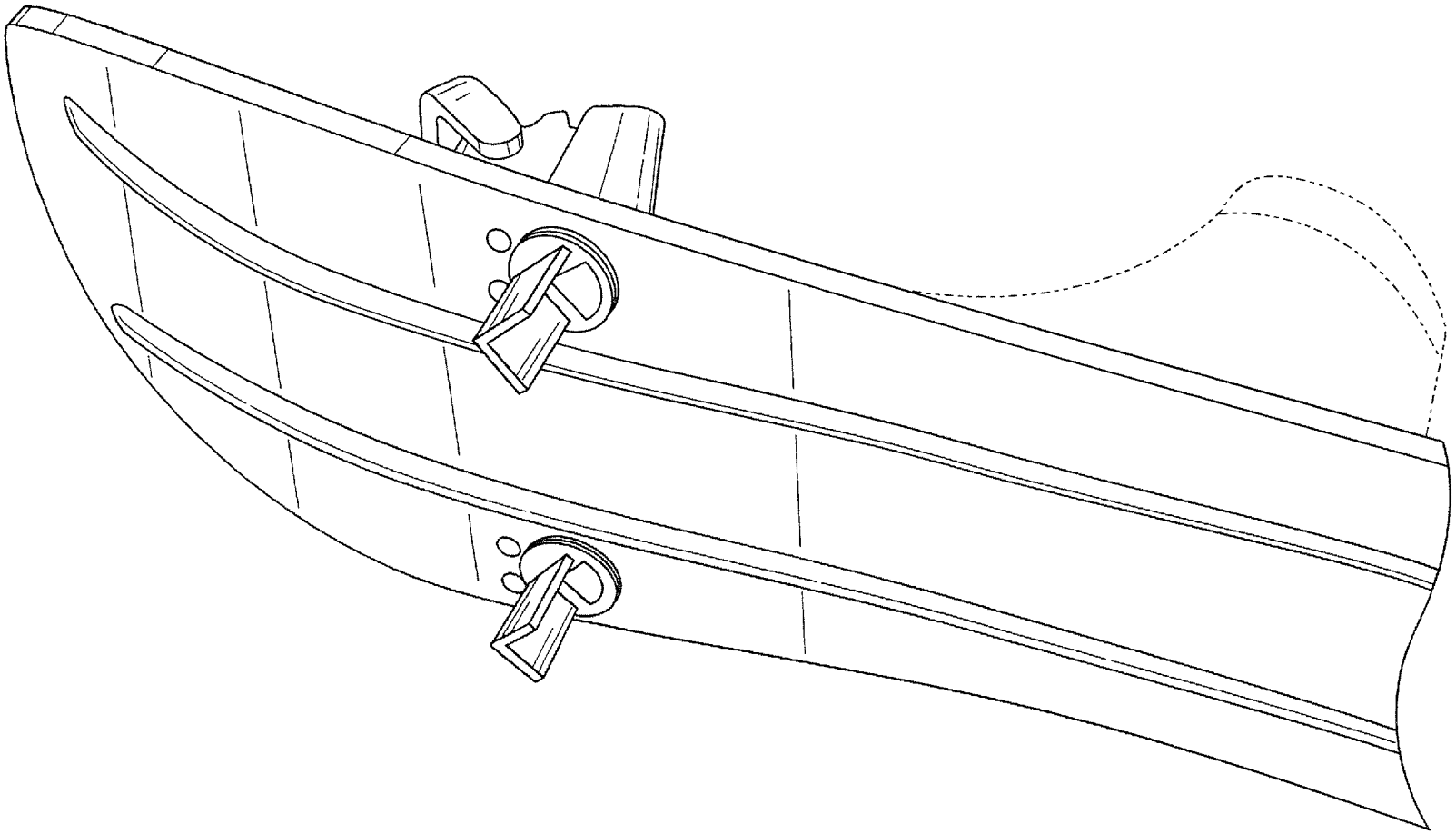
FIG. 9C is a close-up view showing the two cleats fully extended.
Figure 9D:
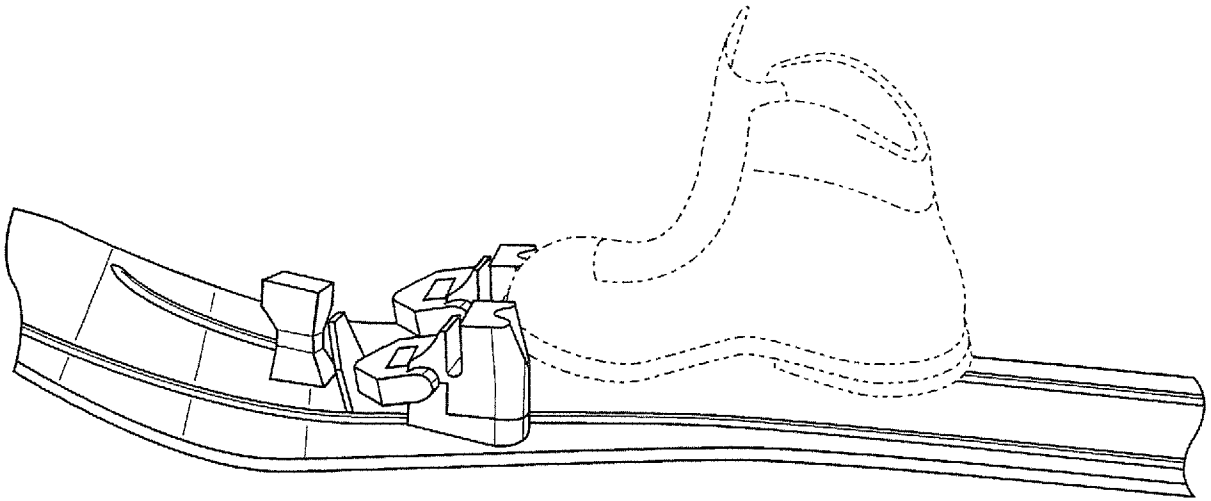
FIGS. 9D-9H show the cleats retracted, partially extended and fully extended, and also illustrate how the pivoting cleat operator is engaged with the cleats via the wire, and how it is used to move the cleats.
Figure 9E:
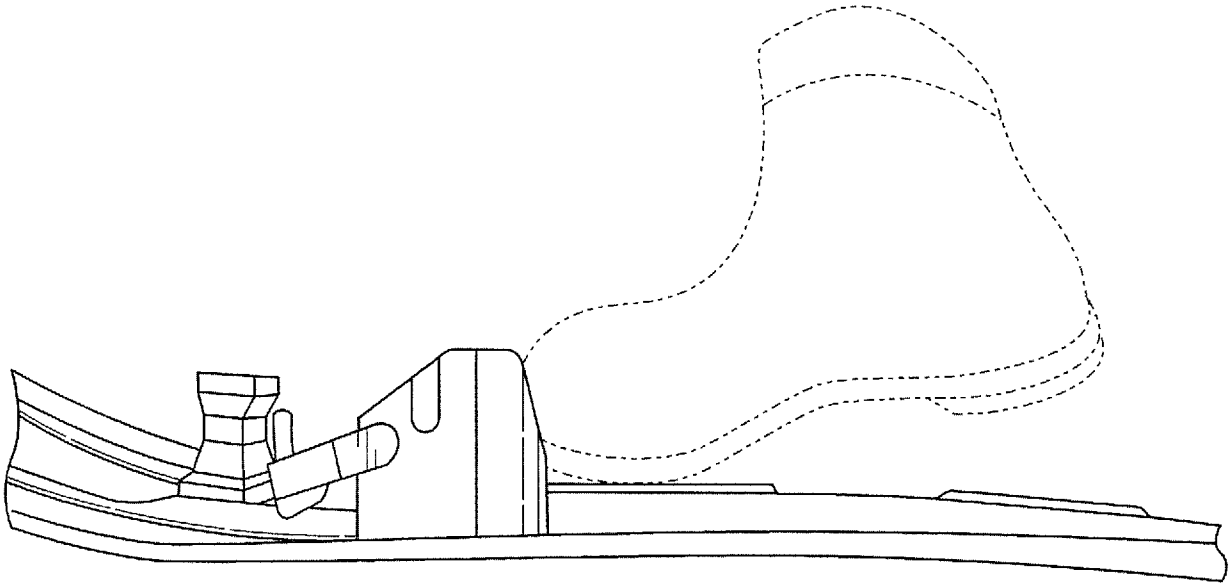
Figure 9F:
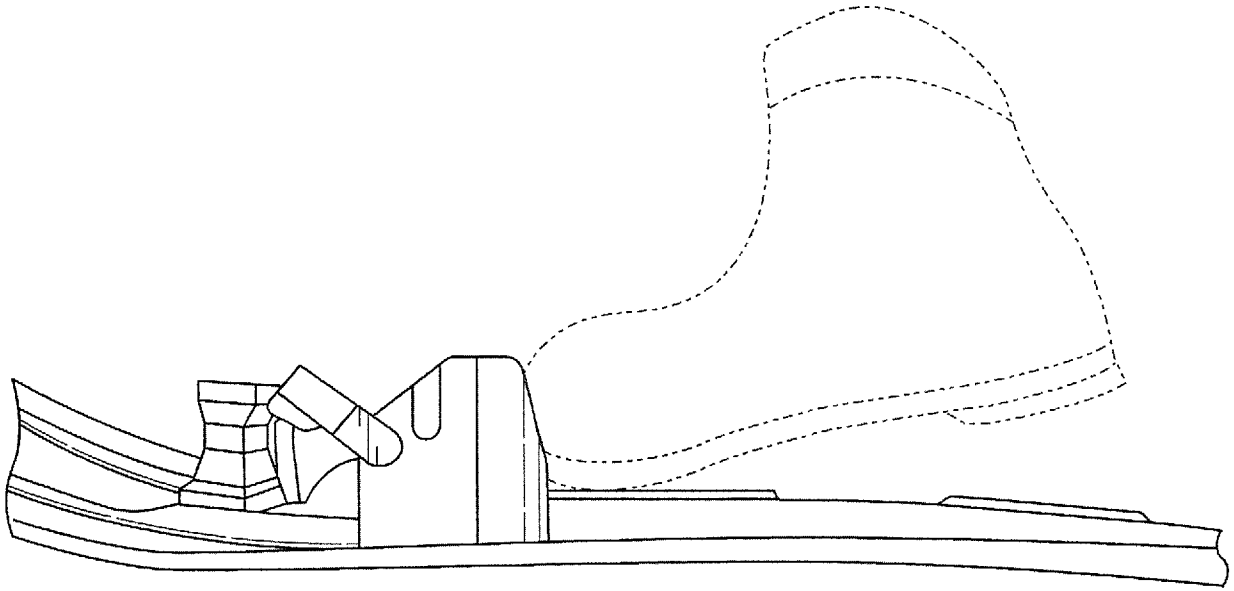
Figure 9G:
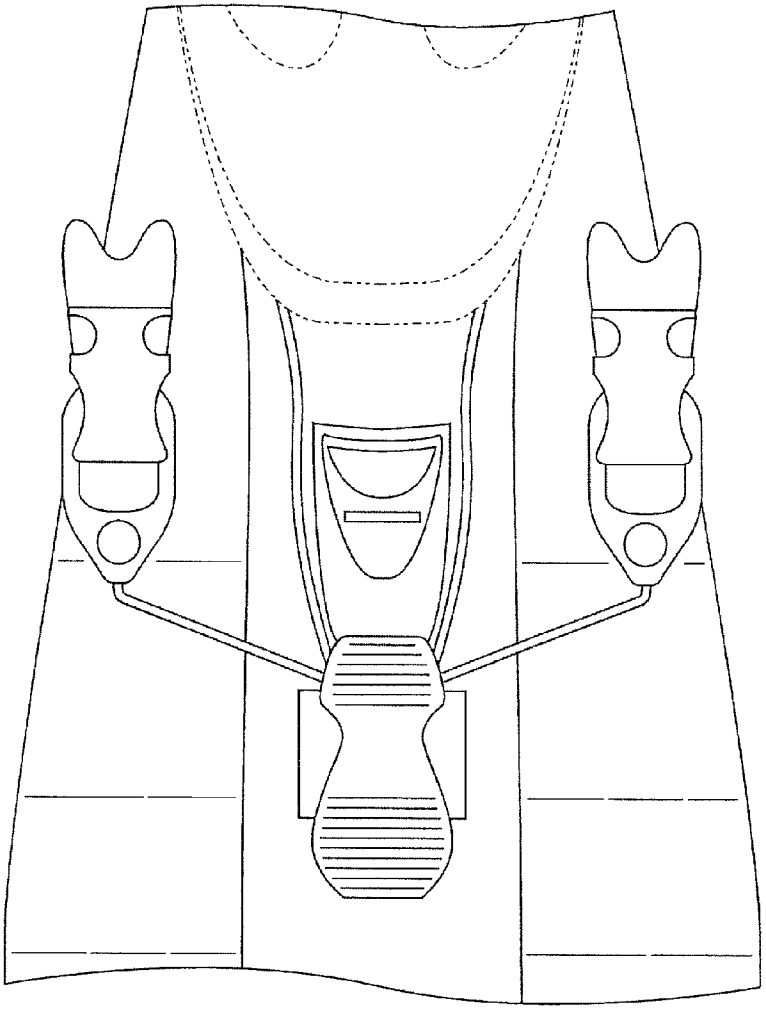
Figure 9H:
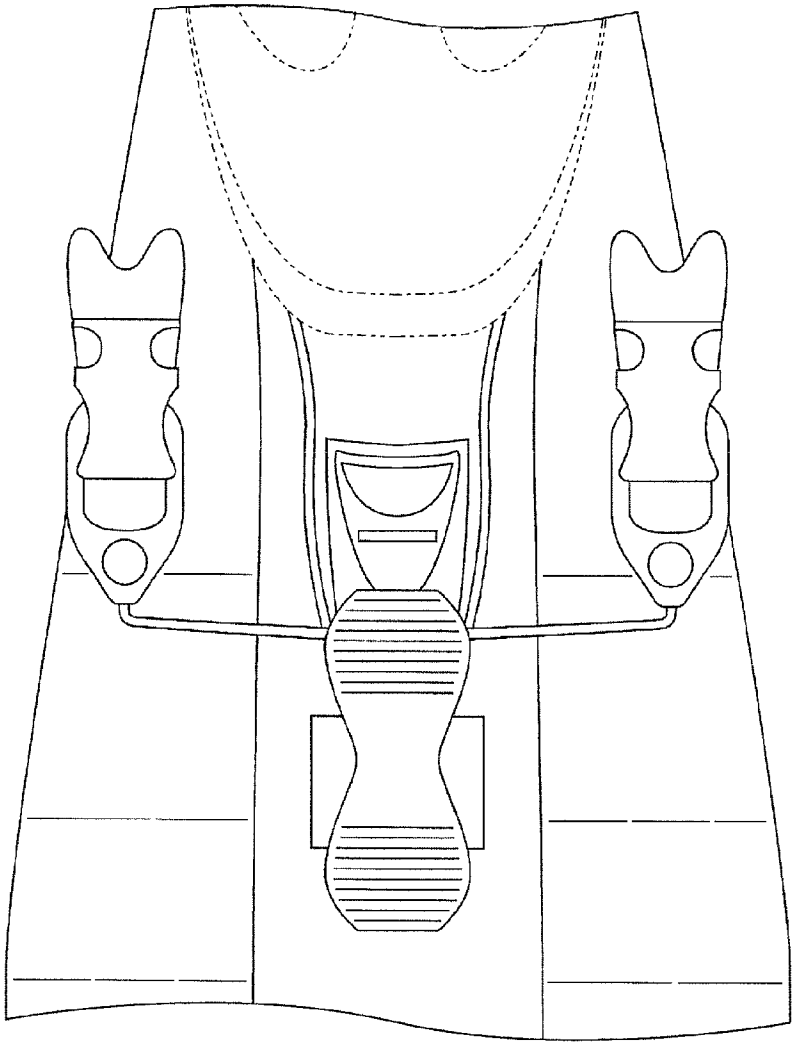

FIG. 9A is a top perspective view of the snow mobility device with a boot mounted thereon; FIG. 9B is a bottom perspective view of the snow mobility device with the two cleats retracted; and FIG. 9C is a close-up view showing the two cleats fully extended. FIGS. 9D-9H show the cleats retracted, partially extended and fully extended, respectively, and also illustrate how the pivoting cleat operator is engaged with the cleats via the wire, and how it is used to move the cleats.

One example shown in the drawings is depicted fully assembled (but without the pivoting cleat operator) in FIGS. 9A-9C in which snow mobility device 100 includes two primary components—generally planar deck 10 that is shown in FIG. 1 and two of the cleat assemblies shown in FIGS. 2-6. The cleat assemblies are attached to the top of the deck so that the cleats project through holes 24 and 26 in deck 10 as is apparent from the drawings. Deck 10 has top surface 12 and bottom surface 30 and defines a front portion 14, a rear portion 16, and a middle portion 18 between the front and rear. The middle portion is cambered. The outer edges are preferably rounded or radiused so the edges grip but do not dig into the snow. Deck 10 includes integral rails 20 and 22 that are molded into the deck and have a generally triangular cross-sectional shape with the vertex located farthest from the deck below bottom 30. The rails are generally spaced evenly from the two edges and flare outwardly slightly towards front portion 14 to create a wider opening 32 that tends to funnel snow into and between the rails to help with stability and control. Front 14 is turned upwardly into a scoop shape and the rails diverge outwardly toward the front; together this helps to direct snow into the scoop area and also helps the tip to ride above the snow. There can be a raised central platform 41 in the central region of the device, located between the rails. This profile stiffens the device and also provides a raised surface that the binding can be mounted to. Since the device is stiffened, the whole deck can be made thinner than would be the case without the platform. This decreases the weight of the platform. The back-country ski bindings allow the foot to pivot up and down about the toe, while keeping the toes above the deck; this leads to the ability to glide. Not shown in the drawings is the option of temporarily or permanently mounting climbing skins to the underside of the devices.

Cleat assemblies 50 comprise housing 60 that itself comprises base 62 and cover 64 that are held together with screws passed through the cover such as through openings 95 and 96. Cover 64 defines a front downwardly projecting lip 94 that creates a concave area that accepts portion 91 of axle or lever 52. Ball 92*a* of extending lever 92 is captured within and can rotate within opening 79 in cleat 54. This arrangement allows the user to push or pull extending end 90 up and down to extend and retract cleat 54 relative to the bottom of the deck as shown in FIGS. 9B and 9C. Bottom portion 80 of cleat 54 is what is extended outwardly into the snow. Cleat 54 is preferably generally "V"-shaped in profile as shown, with the point 78 facing forward. The retractable and extendable cleats allow the user to create a variable amount of drag to help with traction and control.

Pivoting cleat operator 150 is an optional assembly that would be mounted forward of the two cleat assemblies and tie them together so that the two cleats can be extended and retracted together, in unison. Operator 150 comprises pivot hinge block 160 with base 162 that is mounted to the top of the deck and projections 163 and 164 which define saddles 165*a* and 165*b* at the top. Toggle lever 152 has pivot pins 157 that sit in saddles 165*a* and *b* so that lever 52 can pivot about pivot axis 170. Lever 152 defines concave depressions 154 and 156 that can be pushed down to pivot the lever back and forth. Pivot hinge cap 166 sits over lever 152 to hold it in place via bridge 168. Openings 167 accommodate pivot pins 157. Wire 182, FIG. 8, fits through slot 158; portion 188 is located in this slot while ends 184 and 186 fit into openings 53 in end 90 of lever 52. Thus, when the user pushes down on surface 154 or 156 the resulting pivot cause lever 52 to pivot and thus the two cleats to extend and retract in unison. A detent is used to hold the lever in one of four positions; the spring-loaded ball sits in depression 166 and engages with one of four arc-shaped receiving cavities 159*a*-159*d*.

Other constructions are contemplated herein. There can be one or more cleats. The cleats can have a different shape. They can be extended and retracted with different mechanisms. When the mechanisms are tied together, the manner they are tied and moved in unison can differ. All these options will keep the invention within the scope of the claims.

Although aspects of the invention are shown in some drawings and not others, this is not a limitation as the features can be combined in any technically feasible way. And other embodiments will occur to those skilled in the technical field.

What is claimed is:

1. A snow mobility device that defines a longitudinal axis, the snow mobility device comprising:

a generally planar deck with a top surface and a bottom surface, the deck defining a front portion, a rear portion, a middle portion and outer edges, wherein the middle portion is generally flat except for a raised platform in its middle, and the front and rear portions are each curved upwardly, and wherein the edges are rounded;

two rails extending outwardly from the bottom surface along all of the middle portion and at least some of each of the front and rear portions, the rails spaced from one another and essentially parallel to the longitudinal axis of the snow mobility device, wherein the rails are generally triangular shaped in cross section, with the base on the bottom of the deck and the vertex located farthest from the bottom, wherein the rails are essentially equally spaced from the longitudinal edges of the deck and wherein the rails are generally parallel along their lengths except for along the front portion where they diverge outwardly from each other, to define a funnel that guides snow into the space between the rails, and wherein the rails extend close to or all the way to the edges of the front portion; and a pair of retractable cleats coupled to the deck, wherein the cleats are generally "V"-shaped, wherein each cleat is part of a cleat assembly that comprises a lever that couples with the cleat, and a housing that holds the lever such that it can be operated by a user to extend and retract the cleat relative to the deck, wherein each cleat assembly comprises a cleat, a lever, a housing base and a housing cover, wherein the base is attached to the deck and the lever comprises a structure located inside of the cover and that fits into an opening in the cleat.

2. The snow mobility device of claim 1 wherein the levers are operable together.

3. The snow mobility device of claim 2 wherein the levers are operable together via a pivot mechanism.

4. The snow mobility device of claim 3 wherein pivot mechanism is mounted forward of the two cleat assemblies and ties them together so that the two cleats can be extended and retracted together, in unison.

5. The snow mobility device of claim 4 further comprising a wire that is held in the pivot mechanism and in both cleat assemblies, to tie all three together and so the cleat assemblies may be operated in unison via the pivot mechanism and the wire.

6. A snow mobility device that defines a longitudinal axis, the snow mobility device comprising:

a generally planar deck with a top surface and a bottom surface, the deck defining a front portion, a rear portion, a middle portion and outer edges, wherein the middle portion is generally flat and the front and rear portions are each curved upwardly, and wherein the edges are rounded;

at least two rails extending outwardly from the bottom surface of the deck along all of the middle portion and at least some of each of the front and rear portions, the rails spaced from one another and essentially parallel to the longitudinal axis of the snow mobility device;

wherein the rails are essentially equally spaced from the longitudinal edges of the deck; and wherein the rails are generally parallel along their lengths except for along the front portion where they diverge outwardly from each other, to define a funnel that guides snow into the space between the rails.

7. The snow mobility device of claim 6 wherein the rails are generally triangular shaped in cross section, with the base on the bottom of the deck and the vertex located farthest from the bottom.

8. A snow mobility device that defines a longitudinal axis, the snow mobility device comprising:

a generally planar deck with a top surface and a bottom surface, the deck defining a front portion, a rear portion, a middle portion and outer edges, wherein the middle portion is generally flat and the front and rear portions are each curved upwardly, and wherein the edges are rounded;

at least two rails extending outwardly from the bottom surface of the deck along all of the middle portion and at least some of each of the front and rear portions, the rails spaced from one another and essentially parallel to the longitudinal axis of the snow mobility device;

one or more retractable cleats coupled to the deck, wherein each cleat is part of a cleat assembly that is coupled to the deck and comprises a lever that couples with the cleat, and a housing that holds the lever such that it can be operated by a user to extend and retract the cleat relative to the deck; and wherein each cleat assembly comprises a cleat, a lever, a housing base and a housing cover, wherein the base is attached to the deck and the lever comprises a structure located inside of the cover and that fits into an opening in the cleat.

9. The snow mobility device of claim 6 wherein the rails extend to the edges of the front portion.

10. The snow mobility device of claim 8 wherein the cleats are generally "V"-shaped.

11. The snow mobility device of claim 8 wherein the levers are operable together.

12. The snow mobility device of claim 11 wherein the levers are operable together via a pivot mechanism.

13. The snow mobility device of claim 12 wherein the pivot mechanism is mounted forward of the two cleat assemblies and acts to tie them together so that the two cleats can be extended and retracted together, in unison.

14. The snow mobility device of claim 13 further comprising a wire that is held in the pivot mechanism and in both cleat assemblies, to tie all three together.

* * * * *